US010989016B2

(12) United States Patent
Tonti et al.

(10) Patent No.: US 10,989,016 B2
(45) Date of Patent: Apr. 27, 2021

(54) DOWNHOLE TOOL WITH AN EXPANDABLE SLEEVE, GRIT MATERIAL, AND BUTTON INSERTS

(71) Applicant: INNOVEX DOWNHOLE SOLUTIONS, INC., The Woodlands, TX (US)

(72) Inventors: Nick Tonti, The Woodlands, TX (US); Justin Kellner, Adkins, TX (US); Carl Martin, The Woodlands, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 229 days.

(21) Appl. No.: 16/117,089

(22) Filed: Aug. 30, 2018

(65) Prior Publication Data

US 2020/0072019 A1 Mar. 5, 2020

(51) Int. Cl.
*E21B 33/129* (2006.01)
*E21B 33/128* (2006.01)

(52) U.S. Cl.
CPC ..... *E21B 33/1293* (2013.01); *E21B 33/1285* (2013.01)

(58) Field of Classification Search
CPC ..... E21B 33/1293; E21B 33/1285
See application file for complete search history.

(56) References Cited

U.S. PATENT DOCUMENTS 2,189,697 A 2/1940 Baker
2,222,233 A 11/1940 Mize
2,225,143 A 12/1940 Baker et al.
4,155,404 A * 5/1979 Hollingsworth ..... E21B 33/14 166/187
4,483,399 A 11/1984 Colgate
(Continued)

FOREIGN PATENT DOCUMENTS

AR 091776 A1 2/2015
AU 2010214651 A1 3/2012
(Continued)

OTHER PUBLICATIONS

Tae Wook Park (Authorized Officer), International Search Report and Written Opinion dated Nov. 1, 2018, PCT Application No. PCT/US2018/042993, filed Jul. 20, 2018, pp. 1-14.
(Continued)

*Primary Examiner* — Steven A MacDonald
(74) *Attorney, Agent, or Firm* — MH2 Technology Law Group LLP

(57) ABSTRACT

A downhole tool includes an expandable sleeve having an outer surface. The expandable sleeve is configured to expand radially outwards without fracturing apart. The tool also includes a plurality of button inserts positioned at least partially in the expandable sleeve and extending outward past the outer surface by a first distance, so as to engage a surrounding tubular when the expandable sleeve is expanded. The tool further includes a first band of grit material on the outer surface, adjacent to at least one row of the plurality of button inserts. The first band of grit material extends outward from the outer surface by at least the first distance, to shield the plurality of button inserts during run-in of the downhole tool.

30 Claims, 6 Drawing Sheets

(56) References Cited

U.S. PATENT DOCUMENTS 4,901,794 A * 2/1990 Baugh ..... E21B 23/01 166/118
5,131,468 A 7/1992 Lane et al.
5,325,923 A 7/1994 Surjaatmadja et al.
5,396,957 A 3/1995 Surjaatmadja et al.
5,479,986 A 1/1996 Gano et al.
5,623,993 A 4/1997 Buskirk et al.
5,709,269 A 1/1998 Head
5,984,007 A 11/1999 Yuan et al.
6,167,963 B1 1/2001 McMahan et al.
6,220,349 B1 4/2001 Vargus et al.
6,354,373 B1 3/2002 Vercaemer et al.
6,446,323 B1 9/2002 Metcalfe et al.
6,662,876 B2 12/2003 Lauritzen
6,684,958 B2 2/2004 Williams et al.
6,702,029 B2 3/2004 Metcalfe et al.
6,722,437 B2 4/2004 Vercaemer et al.
6,976,534 B2 12/2005 Sutton et al.
7,093,656 B2 8/2006 Maguire
7,104,322 B2 9/2006 Whanger et al.
7,150,318 B2 12/2006 Freeman
7,168,494 B2 1/2007 Starr et al.
7,168,499 B2 1/2007 Cook et al.
7,172,025 B2 2/2007 Eckerlin
7,195,073 B2 3/2007 Fraser, III
7,255,178 B2 8/2007 Slup et al.
7,273,110 B2 9/2007 Pedersen et al.
7,322,416 B2 1/2008 Burns, II et al.
7,350,582 B2 4/2008 McKeachnie et al.
7,350,588 B2 4/2008 Abercrombie Simpson et al.
7,363,967 B2 4/2008 Bunis, II et al.
7,367,389 B2 5/2008 Duggan et al.
7,367,391 B1 5/2008 Stuart et al.
7,373,990 B2 5/2008 Harrall et al.
7,395,856 B2 7/2008 Murray
7,422,060 B2 9/2008 Hammami et al.
7,451,815 B2 11/2008 Halley, Jr.
7,464,764 B2 12/2008 Xu
7,475,736 B2 1/2009 Lehr et al.
7,503,392 B2 3/2009 King et al.
7,520,335 B2 4/2009 Richard et al.
7,527,095 B2 5/2009 Bloess et al.
7,530,582 B2 5/2009 Truchsess et al.
7,552,766 B2 6/2009 Gazewood
7,562,704 B2 7/2009 Wood et al.
7,584,790 B2 9/2009 Johnson
7,603,758 B2 10/2009 Cook et al.
7,607,476 B2 10/2009 Tom et al.
7,647,964 B2 1/2010 Akbar et al.
7,661,481 B2 2/2010 Todd et al.
7,665,537 B2 2/2010 Patel et al.
7,665,538 B2 2/2010 Robisson et al.
7,690,436 B2 4/2010 Turley et al.
7,757,758 B2 7/2010 O'Malley et al.
7,798,236 B2 9/2010 McKeachnie et al.
7,814,978 B2 10/2010 Steele et al.
7,832,477 B2 11/2010 Cavender et al.
7,861,744 B2 1/2011 Fly et al.
7,861,774 B2 1/2011 Fehr et al.
7,921,925 B2 4/2011 Maguire et al.
8,016,032 B2 9/2011 Mandrell et al.
8,047,279 B2 11/2011 Barlow et al.
8,079,413 B2 12/2011 Frazier
8,267,177 B1 9/2012 Vogel et al.
8,276,670 B2 10/2012 Patel
8,291,982 B2 10/2012 Murray et al.
8,307,892 B2 11/2012 Frazier
8,327,931 B2 12/2012 Agrawal et al.
8,336,616 B1 12/2012 McClinton
8,397,820 B2 3/2013 Fehr et al.
8,403,037 B2 3/2013 Agrawal et al.
8,425,651 B2 4/2013 Xu et al.
8,459,347 B2 6/2013 Stout
8,567,494 B2 10/2013 Rytlewski et al.
8,573,295 B2 11/2013 Johnson et al.
8,579,024 B2 11/2013 Mailand et al.
8,631,876 B2 1/2014 Xu et al.
8,636,074 B2 1/2014 Nutley et al.
8,684,096 B2 4/2014 Harris et al.
8,776,884 B2 7/2014 Xu et al.
8,887,818 B1 11/2014 Carr et al.
8,905,149 B2 12/2014 Bailey et al.
8,936,085 B2 1/2015 Boney et al.
8,950,504 B2 2/2015 Xu et al.
8,978,776 B2 3/2015 Spray
8,991,485 B2 3/2015 Chenault et al.
9,010,416 B2 * 4/2015 Xu ..... E21B 33/129 166/212
9,016,363 B2 4/2015 Xu et al.
9,033,041 B2 5/2015 Baihly et al.
9,033,060 B2 5/2015 Xu et al.
9,057,260 B2 * 6/2015 Kelbie ..... E21B 43/26
9,080,403 B2 7/2015 Xu et al.
9,080,439 B2 7/2015 O'Malley et al.
9,101,978 B2 8/2015 Xu et al.
9,206,659 B2 12/2015 Zhang et al.
9,309,733 B2 4/2016 Xu et al.
9,334,702 B2 5/2016 Allen et al.
9,382,790 B2 7/2016 Bertoja et al.
9,574,415 B2 2/2017 Xu et al.
9,605,508 B2 3/2017 Xu et al.
9,752,423 B2 9/2017 Lynk
9,909,384 B2 3/2018 Chauffe et al.
9,976,379 B2 * 5/2018 Schmidt ..... E21B 23/06
10,415,336 B2 * 9/2019 Benzie ..... E21B 33/1293
10,533,392 B2 * 1/2020 Walton ..... E21B 23/06
10,605,018 B2 * 3/2020 Schmidt ..... E21B 33/1291
10,648,275 B2 * 5/2020 Dirocco ..... E21B 33/1208
2003/0062171 A1 4/2003 Maguire et al.
2003/0099506 A1 5/2003 Mosing
2004/0060700 A1 4/2004 Vert et al.
2004/0069485 A1 4/2004 Ringgengberg et al.
2004/0177952 A1 9/2004 Turley et al.
2004/0244968 A1 12/2004 Cook et al.
2005/0011650 A1 1/2005 Harrall et al.
2005/0139359 A1 6/2005 Maurer et al.
2005/0199401 A1 9/2005 Patel et al.
2005/0205266 A1 9/2005 Todd et al.
2005/0211446 A1 9/2005 Ricalton et al.
2005/0217866 A1 10/2005 Watson et al.
2006/0185855 A1 8/2006 Jordan et al.
2007/0000664 A1 1/2007 Ring et al.
2007/0044958 A1 3/2007 Rytlewski et al.
2007/0272418 A1 11/2007 Corre et al.
2008/0066923 A1 3/2008 Xu
2008/0073074 A1 3/2008 Frazier
2008/0135248 A1 6/2008 Talley et al.
2008/0142223 A1 6/2008 Xu et al.
2009/0044949 A1 2/2009 King et al.
2009/0065196 A1 3/2009 Holland et al.
2009/0205843 A1 * 8/2009 Gandikota ..... E21B 43/103 166/387
2009/0242213 A1 10/2009 Braddick
2009/0266560 A1 10/2009 Ring et al.
2010/0032167 A1 2/2010 Adam et al.
2010/0116489 A1 5/2010 Nelson
2010/0170682 A1 7/2010 Brennan, III et al.
2010/0270031 A1 10/2010 Patel
2010/0270035 A1 10/2010 Ring et al.
2010/0276159 A1 11/2010 Mailand et al.
2010/0314127 A1 12/2010 Swor et al.
2010/0319427 A1 12/2010 Lohbeck
2010/0319927 A1 12/2010 Yokley et al.
2011/0005779 A1 1/2011 Lembcke
2011/0048743 A1 3/2011 Stafford et al.
2011/0132143 A1 6/2011 Xu et al.
2011/0132619 A1 6/2011 Agrawal et al.
2011/0132621 A1 6/2011 Agrawal et al.
2011/0132623 A1 6/2011 Moeller
2011/0240295 A1 10/2011 Porter et al.
2011/0266004 A1 11/2011 Hallundbaek et al.
2011/0284232 A1 11/2011 Huang
2012/0024109 A1 2/2012 Xu et al.
2012/0055669 A1 3/2012 Levin et al.

(56) References Cited

U.S. PATENT DOCUMENTS

| | | | | |
|---|---|---|---|---|
| 2012/0067583 | A1 | 3/2012 | Zimmerman et al. | |
| 2012/0097384 | A1* | 4/2012 | Valencia | E21B 33/1204 166/134 |
| 2012/0111566 | A1 | 5/2012 | Sherman et al. | |
| 2012/0118583 | A1 | 5/2012 | Johnson et al. | |
| 2012/0132426 | A1 | 5/2012 | Xu et al. | |
| 2012/0168163 | A1 | 7/2012 | Bertoja et al. | |
| 2012/0199341 | A1 | 8/2012 | Kellner et al. | |
| 2012/0205873 | A1 | 8/2012 | Turley | |
| 2012/0247767 | A1 | 10/2012 | Themig et al. | |
| 2012/0273199 | A1 | 11/2012 | Cresswell et al. | |
| 2013/0008671 | A1 | 1/2013 | Booth | |
| 2013/0062063 | A1 | 3/2013 | Baihly et al. | |
| 2013/0081825 | A1 | 4/2013 | Lynde et al. | |
| 2013/0186615 | A1 | 7/2013 | Hallubaek et al. | |
| 2013/0186616 | A1* | 7/2013 | Xu | E21B 33/129 166/212 |
| 2013/0192853 | A1* | 8/2013 | Themig | E21B 33/1216 166/387 |
| 2013/0299185 | A1 | 11/2013 | Xu et al. | |
| 2014/0014339 | A1 | 1/2014 | O'Malley et al. | |
| 2014/0076571 | A1 | 3/2014 | Frazier et al. | |
| 2014/0022447 | A1 | 8/2014 | Wiese | |
| 2014/0238700 | A1* | 8/2014 | Williamson | E21B 33/128 166/387 |
| 2014/0262214 | A1* | 9/2014 | Mhaskar | E21B 33/1291 166/216 |
| 2015/0027737 | A1* | 1/2015 | Rochen | E21B 23/01 166/382 |
| 2015/0068757 | A1 | 3/2015 | Hofman et al. | |
| 2015/0075774 | A1 | 3/2015 | Raggio | |
| 2015/0129215 | A1* | 5/2015 | Xu | E21B 33/12 166/285 |
| 2015/0184485 | A1* | 7/2015 | Xu | E21B 33/129 166/118 |
| 2015/0218904 | A1 | 8/2015 | Chauffe et al. | |
| 2016/0160591 | A1* | 6/2016 | Xu | E21B 23/06 166/382 |
| 2016/0186511 | A1* | 6/2016 | Coronado | E21B 33/129 166/381 |
| 2016/0305215 | A1 | 10/2016 | Harris et al. | |
| 2016/0312557 | A1 | 10/2016 | Kitzman | |
| 2017/0022781 | A1* | 1/2017 | Martin | E21B 33/1208 |
| 2017/0101843 | A1 | 4/2017 | Waterhouse et al. | |
| 2017/0130553 | A1* | 5/2017 | Harris | E21B 33/1208 |
| 2017/0218711 | A1 | 8/2017 | Kash | |
| 2017/0260824 | A1* | 9/2017 | Kellner | B22F 7/06 |
| 2018/0030807 | A1* | 2/2018 | Martin | E21B 33/1208 |
| 2018/0266205 | A1* | 9/2018 | Martin | E21B 33/128 |
| 2019/0106961 | A1* | 4/2019 | Hardesty | E21B 33/1208 |
| 2020/0072019 | A1* | 3/2020 | Tonti | E21B 33/1285 |
| 2020/0131882 | A1* | 4/2020 | Tonti | E21B 33/129 |

FOREIGN PATENT DOCUMENTS

| | | | |
|---|---|---|---|
| EP | 2251525 | A1 | 11/2010 |
| GB | 2345308 | A | 7/2000 |
| GB | 2448449 | A | 10/2008 |
| GB | 2448449 | B | 12/2008 |
| GB | 2482078 | A | 1/2012 |
| WO | 2010039131 | A1 | 4/2010 |
| WO | 2011/023743 | A2 | 11/2011 |
| WO | 2011/137112 | A2 | 11/2011 |
| WO | 2014/014591 | A1 | 1/2014 |
| WO | 2014014591 | A1 | 1/2014 |
| WO | 2014/100072 | A1 | 6/2014 |
| WO | 2016/160003 | A1 | 10/2016 |
| WO | 2017/151384 | A1 | 9/2017 |

OTHER PUBLICATIONS

Tae Wook Park (Authorized Officer), International Search Report and Written Opinion dated Nov. 4, 2016, PCT Application No. PCT/US2016/043545, filed Jul. 22, 2016, pp. 1-18.

Hinkie et al., "Multizone Completion with Accurately Placed Stimulation Through Casing Wall", SPE Production and Operations Symposium, Mar. 31-Apr. 3, 2007, pp. 1-4.

Anjum et al., "Solid Expandable Tubular Combined with Swellable Elastomers Facilitate Multizonal Isolation and Fracturing, with Nothing Left in the Well Bore to Drill for Efficient Development of Tight Gas Reservoirs in Cost Effective Way", SPE International Oil & Gas Conference, Jun. 8-10, 2010, pp. 1-16.

Vargus et al., "Completion System Allows for Interventionless Stimulation Treatments in Horizontal Wells with Multiple Shale Pay Zones", SPE Annual Technical Conference, Sep. 2008, pp. 1-8.

Gorra, et al., "Expandable Zonal Isolation Barrier (ZIB) Provides a Long-Term Well Solution as a High Differential Pressure Metal Barrier to Flow", Brazilian Petroleum Technical Papers, 2010, Abstract only, 1 page.

Vargus, et al., "System Enables Multizone Completions", the American Oil & Gas Reporter, 2009, Abstract only, 1 page.

Vargus, et al., "Completion System Allows for Interventionless Stimulation Treatments in Horizontal Wells with Multiple Shale Pay Zones", Annual SPE Technical Conference, Sep. 2008, Abstract only, 1 page.

Carl Martin et al., "Downhole Tool With an Expandable Sleeve", U.S. Appl. No. 15/217,090, filed Jul. 22, 2016.

Carl Martin et al., "Downhole Tool With an Expandable Sleeve", U.S. Appl. No. 15/727,390, filed Oct. 6, 2017.

Carl Martin et al., "Dowhnhole Tool With an Expandable Sleeve", U.S. Appl. No. 15/985,637, filed May 21, 2018.

Justin Kellner et al., "Slip Segment Fora Downhole Tool", U.S. Appl. No. 15/064,312, filed Mar. 8, 2016.

Zhang et al., High Strength Nanostructured Materials and Their Oil Field Applications, SPE 157092, SPE International, 2012, pp. 1-6.

Xu et al., Smart Nanostructured Materials Deliver High Reliability Completion Tools for Gas Shale Fracturing, SPE 146586, SPE International, 2011, pp. 1-6.

Larimore et al., Overcoming Completion Challenges with Interventionless Devices—Case Study—the "Disappearing Plug", SPE 63111, SPE International, 2000, pp. 1-13.

King et al., A Methodology for Selecting Interventionless Packer Setting Techniques, SPE-90678-MS, Society of Petroleum Engineers, 2004, pp. 1-3.

Xu et al., Declaration Under 37 CFR 1.132, U.S. Appl. No. 14/605,365, filed Jan. 26, 2015, pp. 1-4.

Non-Final Office Action dated May 20, 2014, U.S. Appl. No. 13/466,322, filed May 8, 2012, pp. 1-111.

Notice of Allowance dated Sep. 16, 2014, U.S. Appl. No. 13/466,322, filed May 8, 2012, pp. 1-10.

Notice of Allowance dated Oct. 29, 2014, U.S. Appl. No. 13/466,322, filed May 8, 2012, pp. 1-10.

Non-Final Office Action dated Aug. 1, 2014, U.S. Appl. No. 13/358,317, filed Jan. 25, 2012, pp. 1-15.

Notice of Allowance dated Jan. 9, 2015, U.S. Appl. No. 13/358,317, filed Jan. 25, 2012, pp. 1-7.

Non-Final Office Action dated Jul. 30, 2014, U.S. Appl. No. 13/466,329, filed May 8, 2012, pp. 1-16.

Final Office Action dated Dec. 18, 2014, U.S. Appl. No. 13/466,329, filed May 8, 2012, pp. 1-12.

Notice of Allowance dated Mar. 11, 2015, U.S. Appl. No. 13/466,329, filed May 8, 2012, pp. 1-5.

Non-Final Office Action dated Nov. 26, 2014, U.S. Appl. No. 13/358,307, filed Jan. 25, 2012, pp. 1-17.

Notice of Allowance dated Mar. 25, 2015, U.S. Appl. No. 13/358,307, filed Jan. 25, 2012, pp. 1-12.

Non-Final Office Action dated Oct. 6, 2014, U.S. Appl. No. 13/358,332, filed Jan. 25, 2012, pp. 1-15.

Notice of Allowance dated Apr. 7, 2015, U.S. Appl. No. 13/358,332, filed Jan. 25, 2012, pp. 1-8.

Non-Final Office Action dated Mar. 17, 2015, U.S. Appl. No. 13/705,972, filed Dec. 5, 2012, pp. 1-23.

Final Office Action dated Oct. 2, 2015, U.S. Appl. No. 13/705,972, filed Dec. 5, 2012, pp. 1-20.

Advisory Action dated Nov. 20, 2015, U.S. Appl. No. 13/705,972, filed Dec. 5, 2012, pp. 1-4.

(56) References Cited

OTHER PUBLICATIONS

Notice of Allowance dated Jan. 29, 2016, U.S. Appl. No. 13/705,972, filed Dec. 5, 2012, pp. 1-5.
Non-Final Office Action dated Jan. 15, 2016, U.S. Appl. No. 14/605,365, filed Jan. 26, 2015, pp. 1-10.
Final Office Action dated Jun. 22, 2016, U.S. Appl. No. 14/605,365, filed Jan. 26, 2015, pp. 1-15.
Advisory Action dated Sep. 21, 2016, U.S. Appl. No. 14/605,365, filed Jan. 26, 2015, pp. 1-4.
Notice of Allowance dated Dec. 19, 2016, U.S. Appl. No. 14/605,365, filed Jan. 26, 2015, pp. 1-7.
Non-Final Office Action dated Jun. 23, 2014, U.S. Appl. No. 13/466,311, filed May 8, 2012, pp. 1-12.
Non-Final Office Action dated Dec. 9, 2014, U.S. Appl. No. 13/466,311, filed May 8, 2012, pp. 1-12.
Non-Final Office Action dated Jun. 25, 2015, U.S. Appl. No. 13/466,311, filed May 8, 2012, pp. 1-17.
Final Office Action dated Dec. 9, 2015, U.S. Appl. No. 13/466,311, filed May 8, 2012, pp. 1-97.
Non-Final Office Action dated Feb. 22, 2016, U.S. Appl. No. 13/466,311, filed May 8, 2012, pp. 1-10.
Final Office Action dated Sep. 6, 2016, U.S. Appl. No. 13/466,311, filed May 8, 2012, pp. 1-24.
Advisory Action dated Dec. 6, 2016, U.S. Appl. No. 13/466,311, filed May 3, 2012, pp. 1-4.
Notice of Allowance dated Feb. 1, 2017, U.S. Appl. No. 13/466,311, filed May 8, 2012, pp. 1-8.

* cited by examiner

DOWNHOLE TOOL WITH AN EXPANDABLE SLEEVE, GRIT MATERIAL, AND BUTTON INSERTS

BACKGROUND

There are various methods by which openings are created in a production liner for injecting fluid into a formation. In a "plug and perf" frac job, the production liner is made up from standard lengths of casing. Initially, the liner does not have any openings through its sidewalls. The liner is installed in the wellbore, either in an open bore using packers or by cementing the liner in place, and the liner walls are then perforated. The perforations are typically created by perforation guns that discharge shaped charges through the liner and, if present, adjacent cement.

The production liner is typically perforated first in a zone near the bottom of the well. Fluids then are pumped into the well to fracture the formation in the vicinity of the perforations. After the initial zone is fractured, a plug is installed in the liner at a position above the fractured zone to isolate the lower portion of the liner. The liner is then perforated above the plug in a second zone, and the second zone is fractured. This process is repeated until all zones in the well are fractured.

The plug and perf method is widely practiced, but it has a number of drawbacks, including that it can be extremely time consuming. The perforation guns and plugs are generally run into the well and operated individually. After the frac job is complete, the plugs are removed (e.g., drilled out) to allow production of hydrocarbons through the liner.

SUMMARY

Embodiments of the disclosure provide a downhole tool including an expandable sleeve having an outer surface. The expandable sleeve is configured to expand radially outwards without fracturing apart. The tool also includes a plurality of button inserts positioned at least partially in the expandable sleeve and extending outward past the outer surface by a first distance, so as to engage a surrounding tubular when the expandable sleeve is expanded, and a first band of grit material on the outer surface, adjacent to at least one row of the plurality of button inserts. The first band of grit material extends outward from the outer surface by at least the first distance, to shield the plurality of button inserts during run-in of the downhole tool.

Embodiments of the disclosure also provide a method for deploying a downhole tool into a wellbore. The method includes positioning the downhole tool in a run-in configuration in a surrounding tubular. The downhole tool includes an expandable sleeve having an outer surface, wherein the expandable sleeve is configured to expand radially outwards, a plurality of button inserts positioned at least partially in the expandable sleeve and extending outward past the outer surface by a first distance, so as to engage a surrounding tubular when the expandable sleeve is expanded, and a first band of grit material on the outer surface, adjacent to at least one row of the plurality of button inserts. The first band grit material extends outward from the outer surface by at least the first distance, to shield the plurality of button inserts during run-in of the downhole tool. The method also includes expanding a first portion of the expandable sleeve, such that the downhole tool is in a first set configuration, and expanding a second portion of the expandable sleeve, such that the downhole tool is in a second set configuration after expanding the second portion of the expandable sleeve.

Embodiments of the disclosure also provide a downhole tool including an expandable sleeve having an outer surface and a bore extending axially therethrough. The expandable sleeve is configured to expand radially outwards without breaking apart. The tool also includes a plurality of button inserts positioned at least partially in the expandable sleeve and extending outward past the outer surface by a first distance, so as to engage a surrounding tubular when the expandable sleeve is expanded. The plurality of button inserts include a first row of button inserts positioned on a first portion of the expandable sleeve, and a second row of button inserts positioned on a second portion of the expandable sleeve, the first and second rows being axially offset. The tool also includes a grit material on the outer surface. The grit material extends outward from the outer surface by at least the first distance, to shield the plurality of button inserts during run-in of the downhole tool. The tool also includes a first cone positioned at least partially in the bore of the expandable sleeve, and a second cone positioned at least partially in the bore of the expandable sleeve. In a run-in configuration of the downhole tool, the first cone is positioned proximal to an uphole end of the expandable sleeve, and the second cone is positioned proximal to a downhole end of the expandable sleeve. In a first set configuration of the downhole tool, the first cone and the second cone are moved closer together in comparison to the run-in configuration, such that at least the first portion of the expandable sleeve is pressed outward. In a second set configuration of the downhole tool, the first cone is moved closer to the second cone, and the second cone is not moved, such that a second portion of the expandable sleeve is pressed outward by the first cone moving from the first set configuration to the second set configuration.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1:
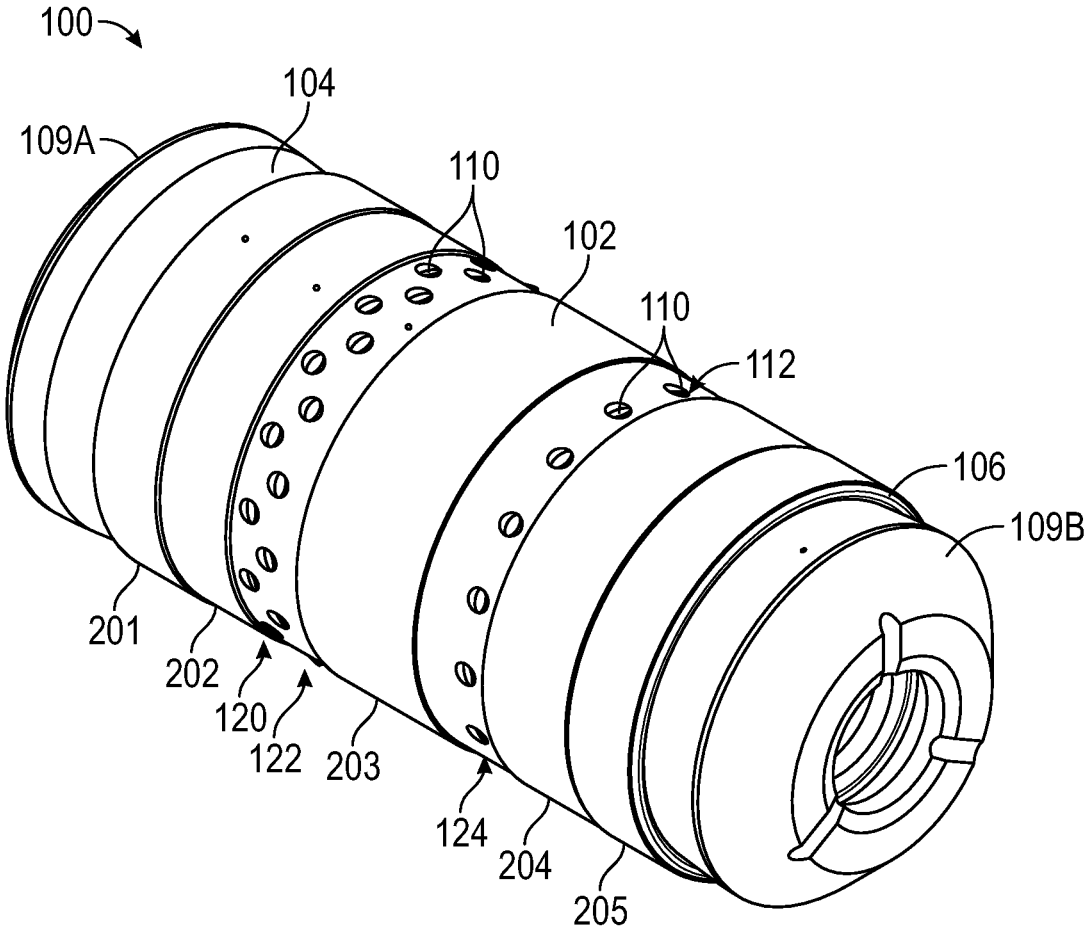
FIG. 1 illustrates a perspective view of a downhole tool in a run-in configuration, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

FIG. 1 illustrates a perspective view of a downhole tool 100, according to an embodiment. The downhole tool 100 includes an expandable sleeve 102, which has an uphole axial end 104 and a downhole axial end 106. The expandable sleeve 102 may be configured to expand radially outwards, e.g., to deform plastically, without breaking apart into separate segments. The expandable sleeve 102 also defines an outer surface 108, which extends axially between the ends 104, 106 and circumferentially about a central longitudinal axis. A pair of cones 109A, 109B are positioned at least partially within the expandable sleeve 102 and are able to be driven toward one another within the expandable sleeve 102, so as to press the expandable sleeve 102 radially outward in a setting process. In an embodiment, the cone 109A may be positioned at or near to the uphole axial end 104, and the cone 109B may be positioned at or near to the downhole axial end 106, when the downhole tool 100 is in a run-in configuration, as shown. Any one or more of the cones 109A, 109B and/or the expandable sleeve 102 may at least partially constructed from a material that is designed to dissolve in the wellbore environment, such as a magnesium alloy.

The downhole tool 100 also includes a plurality of button inserts 110. The button inserts 110 may be received into holes 112 formed in the expandable sleeve 102. Further, the button inserts 110 may be arranged in one or more rows, with each row being positioned at generally a constant axial position and extending around the expandable sleeve 102. For example, the button inserts 110 may include a first row 120, a second row 122, and a third row 124, as shown. The rows 120, 122, 124 may be axially-offset from one another. In this embodiment, the first row 120 is positioned uphole of the second row 122, which is in turn positioned uphole of the third row 124. Further, the first and second rows 120, 122 may be closely proximal to one another, while the third row 124, by comparison, is spaced farther apart from the second row 122.

Figure 2A:
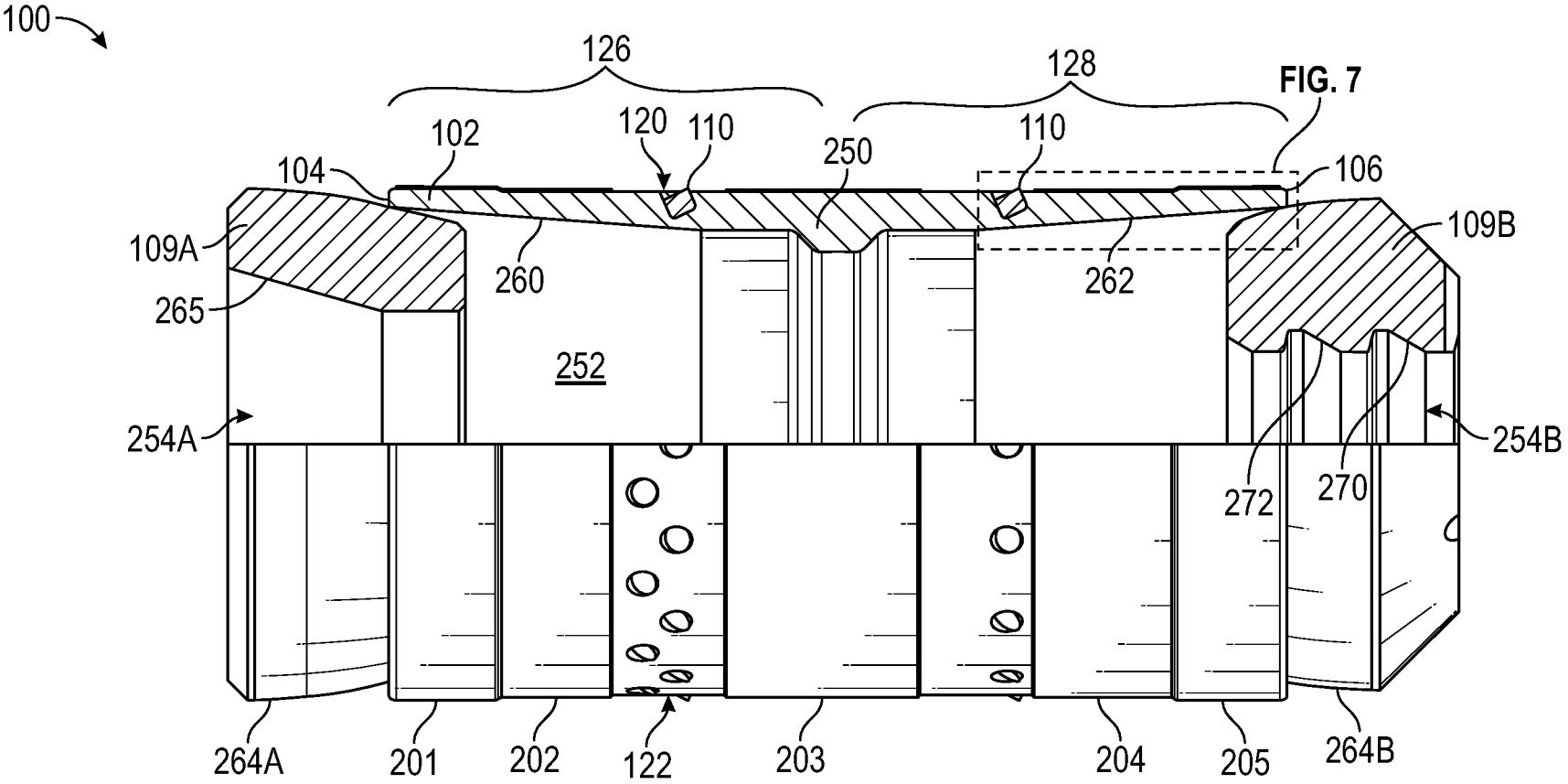
FIG. 2A illustrates a side, half-sectional view of the downhole tool in the run-in configuration, according to an embodiment.

FIG. 2A shows a half-sectional view of the downhole tool 100 in the run-in configuration, according to an embodiment. As indicated, the expandable sleeve 102 may define an upper section 126 and a lower section 128. The first and second rows 120, 122 of button inserts 110 may be positioned in the upper section 126. The third row 124 may be spaced axially apart from the second row 122, and may be positioned in the lower section 128. The rows 120, 122, 124 may be angularly offset from one another as well, e.g., such that button inserts 110 in the first row 120 are circumferentially positioned between button inserts 110 of the second row 122. Moreover, although three rows 120, 122, 124 are shown, it will be appreciated that any number of one or more rows of button inserts 110, and/or other arrangements thereof, may be provided.

Referring to FIGS. 1 and 2A, one or more layers of a grit material may be positioned on the outer surface 108. For example, the layers of grit material may be formed as bands (five bands are shown: 201, 202, 203, 204, 205). The bands 201-205 may or may not extend continuously around the expandable sleeve 102, e.g., in some embodiments, may be disposed at intervals. The layers of grit material in each of the bands 201-205 may extend outwards from the outer surface 108 by a distance that is at least as far as the distance that the button inserts 110 extend outwards from the outer surface 108. The grit material may be any suitable type of friction-increasing material that includes a particulate matter embedded therein. One example of such a grit material is WEARSOX® (commercially available from Innovex Downhole Solutions), which is a metallic material that is applied to a substrate using a thermal-spray process. The grit material may be applied in several steps, such that the grit material is built up and extends outward to the desired dimension and/or shape.

Further, some of the bands 201-205 may extend farther outwards that others. For example, the band 202 may extend outward by a first distance, while the upper-most band 201, which is adjacent thereto, may extend to a second distance outward from the outer surface 108, with the second distance being greater than the first distance. The lower-most band 205 may also extend to the second distance, and the remaining bands 203 and 204 may extend to the first distance. As such, the upper and lower most bands 201, 205 may extend the farthest out. This arrangement may allow the upper and lower-most bands 201, 205 to protect the button inserts 110 and/or the other bands 202-204 from abrasion in the well. Upon expansion of the expandable sleeve 102, as will be explained below, one or more of the bands 201-205 may engage a surrounding tubular (e.g., casing), along with at least some of the button inserts 110, so as to anchor the downhole tool 100 to the surrounding tubular.

FIG. 2A also shows the expandable sleeve 102 including an inner tab or "shoulder" 250, proximal to its axial middle. The upper section 126 may be considered the part of the sleeve 102 that is uphole of the shoulder 250, while the lower section 128 may be considered the part of the sleeve 102 that is downhole of the shoulder 250. As can be seen in the lower portion of this view, the button inserts 110 are positioned in the first and second rows 120, 122 in the upper portion 126, and the third row 124 is in the lower section 128.

Figure 7:
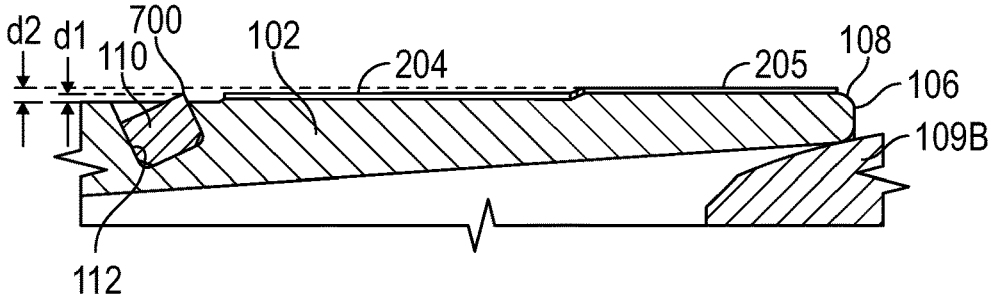
FIG. 7 illustrates an enlarged portion of the dashed box in FIG. 2A, according to an embodiment.

FIG. 7 illustrates the indicated portion of FIG. 2A in greater detail. As mentioned above, the bands 202-204 may extend outwards by a first distance d1, and the upper and lower-most bands 201 and 205 may extend outward by a second distance d2, which is greater than the first distance d1. The difference in distances d1 and d2 may be provided by the bands 201, 205 being thicker than the bands 202-204, or by the outer surface 108 having a stepped profile, as shown. Further, the first distance d1 may be the same as the distance that an outer edge 700 of the button inserts 110 extends to, as shown. As such, the bands 202-204 may be even, in a radial direction, with the outer edge 700.

Referring again to FIG. 2A, the expandable sleeve 102 defines a bore 252 therethrough, extending axially from the uphole axial end 104 to the downhole axial end 106, which allows communication of fluid through the expandable sleeve 102. The cones 109A, 109B each define a bore 254A, 254B therethrough as well, which communicates with the bore 252 of the expandable sleeve 102, thereby allowing fluid flow through the tool 100 when the tool 100 is not plugged.

The bore 252 of the expandable sleeve 102 may form upper and lower tapered sections 260, 262. The tapered sections 260, 262 may decrease in diameter as proceeding from the respective axial ends 104, 106 toward the shoulder 150 positioned therebetween. The shoulder 250 may extend into the bore 252 at a non-zero (e.g. obtuse) angle to each of the tapered sections 260, 262.

The upper cone 109A may be positioned at least partially in the tapered section 260, and the lower cone 109B may be positioned at least partially in the tapered section 262. Specifically, the cones 109A, 109B may each include a tapered outer surface 264A, 264B. The tapered outer surface 264A, 264B may be configured to slide against the tapered upper and lower sections 260, 262 of the bore 252. The cones 109A, 109B may be dimensioned such that, as they are moved toward the shoulder 250, the cones 109A, 109B progressively deform the expandable sleeve 102 radially outwards.

The upper cone 109A may include a valve seat 265, which may be uphole-facing and configured to receive an obstructing member (such as a ball or dart) therein, so as to plug off the bore 252. The catching of the obstructing member may also be configured to move the upper cone 109A relative to the expandable sleeve 102, as will be described in greater detail below. Further, in at least one embodiment, the lower cone 109B may include one or more grooves (two shown: 270, 272). The grooves 270, 272 may be configured to engage shearable and/or deflectable teeth of a setting tool, allowing the setting tool to apply a predetermined amount of force so as to move the lower cone 109B upwards, toward the shoulder 250, while pushing downwards on the upper cone 109A.

Figure 2B:
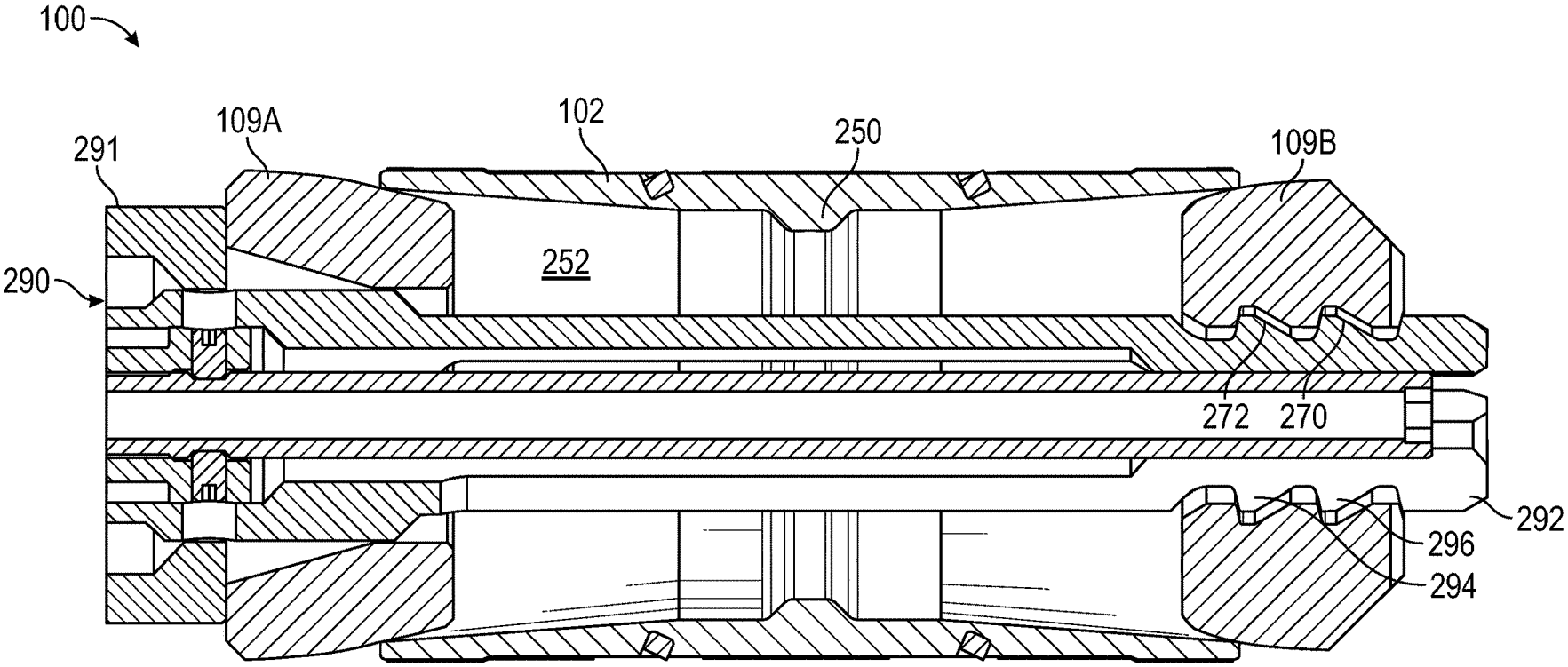
FIG. 2B illustrates a side, cross-sectional view of the downhole tool with a setting assembly coupled thereto, according to an embodiment.

FIG. 2B illustrates a side, cross-sectional view of the downhole tool 100 with a setting assembly 290 in engagement therewith, according to an embodiment. The setting assembly 290 may include a setting sleeve 291, which may be a hollow cylinder configured to bear against the upper cone 109A. Further, the setting assembly 290 may include a setting tool 292, which may extend through the upper cone 109A, through the bore 252, and at least partially through the lower cone 109B. In this embodiment, the setting tool 292 includes two ridges 294, 296, which are shaped to fit into the grooves 270, 272, respectively. As such, to move the downhole tool 100 from the run-in configuration to a first set configuration, the setting assembly 290 may be actuated by pulling uphole on the setting tool 292 and pushing downhole on the setting sleeve 291. This causes the cones 109A, 109B to move toward one another, and toward the shoulder 250. Eventually, the forces applied yield the connection between the setting tool 292 and the lower cone 109B, and the setting assembly 290 is withdrawn.

Figure 3A:
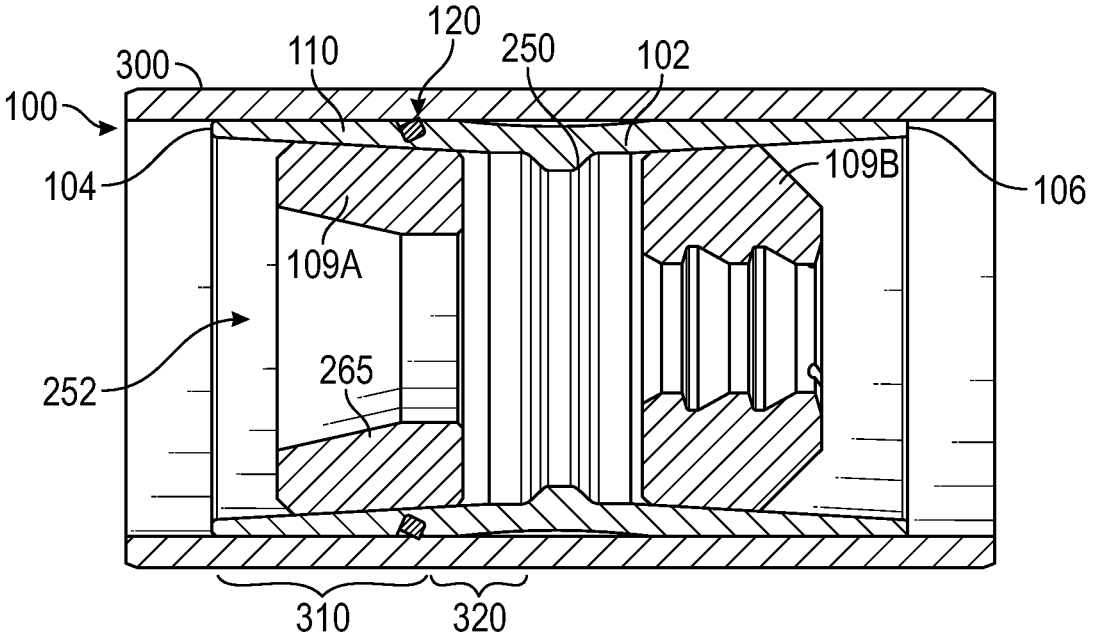
FIGS. 3A and 3B illustrate side, cross-sectional views of the downhole tool in a first set configuration, according to an embodiment.
Figure 3B:
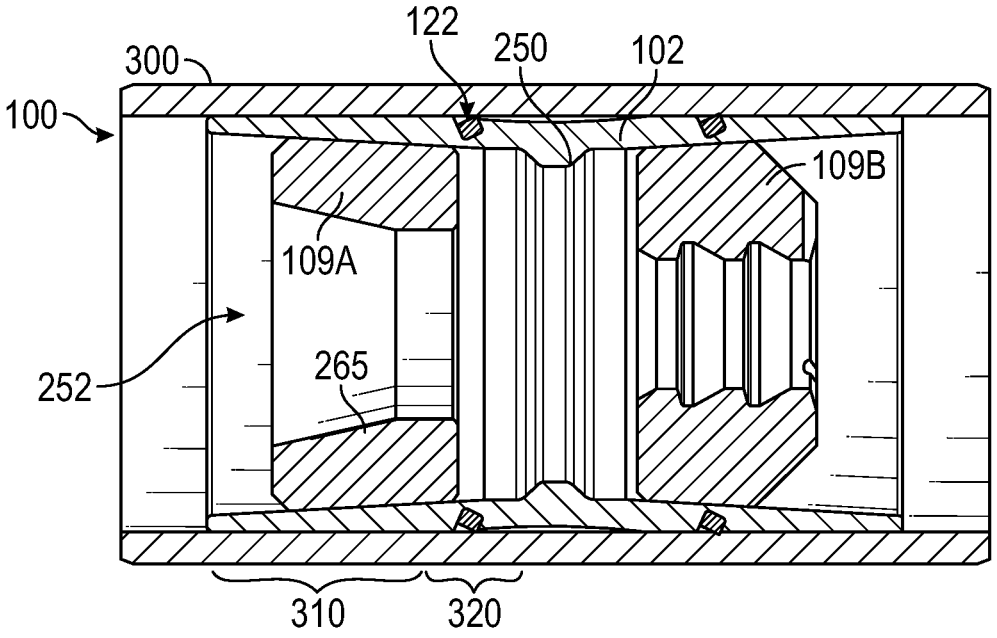

FIGS. 3A and 3B illustrate side, cross-sectional views of the downhole tool 100 in a first set configuration, after the setting assembly 290 (FIG. 2B) is withdrawn, according to an embodiment. FIG. 3A, in particular, shows a cross-section including the first row 120 of button inserts 110, while FIG. 3B shows a cross-section including the second row 122 of button inserts 110, since the button inserts 110 of the rows 120, 122 are misaligned (i.e., angularly offset) from one another, as mentioned above. Further, FIGS. 3A and 3B show the downhole tool 100 deployed in a surrounding tubular 300, which may be casing, liner, the wellbore wall, or any other oilfield tubular, etc.

Comparing the run-in configuration shown in FIGS. 2A and 2B to the first set configuration shown in FIGS. 3A and 3B, it can be seen that the cones 109A, 109B have been moved closer together, and thus closer to the shoulder 250 within the bore 252, e.g., using the setting assembly 290. In the first set configuration, by such movement of the cones 109A, 109B, a first portion 310 of the upper section 126 and part of the lower section 128 have been driven outward into engagement with a surrounding tubular 300, while a second portion 320 of the expandable sleeve 102, e.g., at least the part between the cones 109A, 109B, is unexpanded, or not fully expanded and driven into the surrounding tubular 300.

The button inserts 110 of the first row 120 (FIG. 3A) and the second row 122 are positioned to capitalize on this progressive outward pressing of the outer surface 108 into engagement with the surrounding tubular 300. For example, the button inserts 110 in the first row 120 (FIG. 3A) are in the first portion 310, farther toward the uphole axial end 104 than the button inserts 110 in the second row 122 (FIG. 3B), which are in the second portion 320. Specifically, the rows 120, 122 may be positioned such that the button inserts 110 of the first row 120 fully engage (e.g., are partially embedded into) the surrounding tubular 300, while the button inserts 110 of the second row 122 are either spaced radially apart from the surrounding tubular 300, or at least engage the surrounding tubular 300 significantly less (e.g., are embedded to a lesser extent, apply a lesser gripping force to the surrounding tubular 300, etc.), such that they are pressed into engagement with the surrounding tubular 300 less than are the button inserts 110 of the first row 120. The button inserts 110 of the third row 124 may be positioned correspondingly to the button inserts 110 of the first row 120, such that the button inserts 110 of the third row 124 are fully pressed into engagement with the surrounding tubular 300 in the first set configuration.

In the first set configuration, the upper cone 109A is spaced axially apart from the shoulder 250, and thus is capable of being pushed farther into the bore 252 of the expandable sleeve 102 than in this first set configuration. The lower cone 109B may likewise be spaced from the shoulder 250, although in some embodiments, the lower cone 109B might be configured to engage the shoulder 250 at this stage.

Further, although the bands 201-205 are not shown in this view, referring additionally to FIGS. 1 and 2A, it will be appreciated that in the bands 201-205 are progressively pushed into engagement with the surrounding tubular 300, along with the movement of the cones 109A, 109B, as the tool 100 transitions into the first set configuration. Thus, in this view, for example, the bands 201, 202, 204, 205 may be at least partially driven into engagement with the surrounding tubular 300, while the band 203 may not be in engagement therewith.

Figure 4:
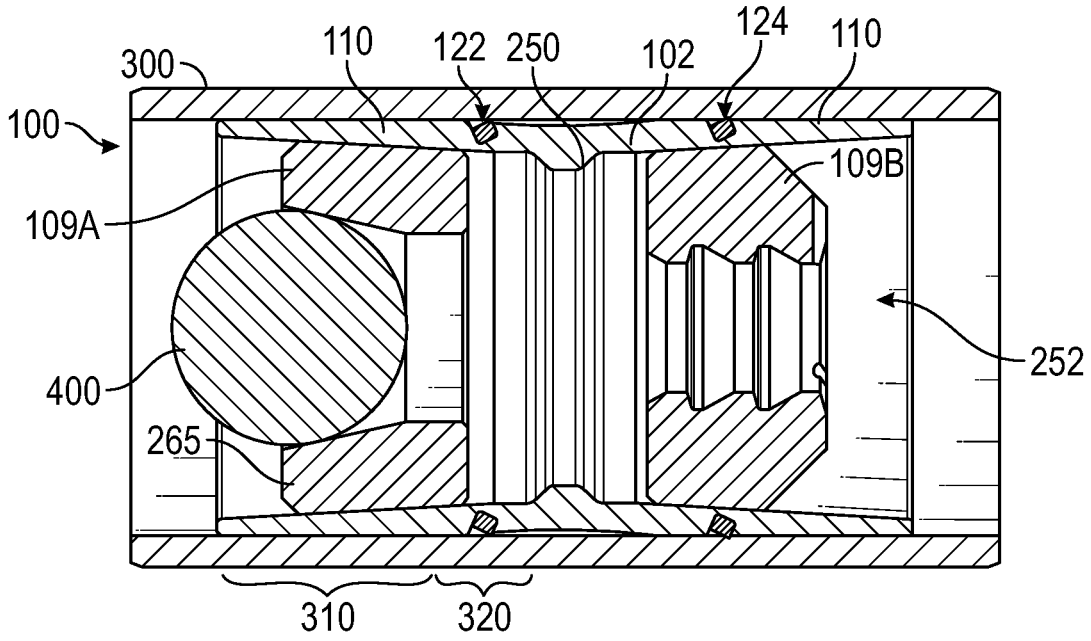
FIG. 4 illustrates a side, cross-sectional view of the downhole tool in the first set configuration with an obstructing member caught therein, according to an embodiment.

FIG. 4 illustrates a side, cross-sectional view of the downhole tool 100, still in the first set configuration and deployed in the surrounding tubular 300, according to an embodiment. This cross-section is similar to the view of FIG. 3B, showing the second and third rows 122 and 124 of button inserts 110, with the first row 120 being circumferentially offset from this cross-section.

As noted above, the upper cone 109A includes a valve seat 265. The valve seat 265 may be a generally tapered, frustoconical (funnel) shape that is configured to receive an obstructing member 400 therein. The obstructing member 400 may be a ball, as shown, but in other embodiments, may be any other suitable shape (dart, etc.). In some embodiments, the obstructing member 400 may be at least partially dissolvable.

Figure 5:
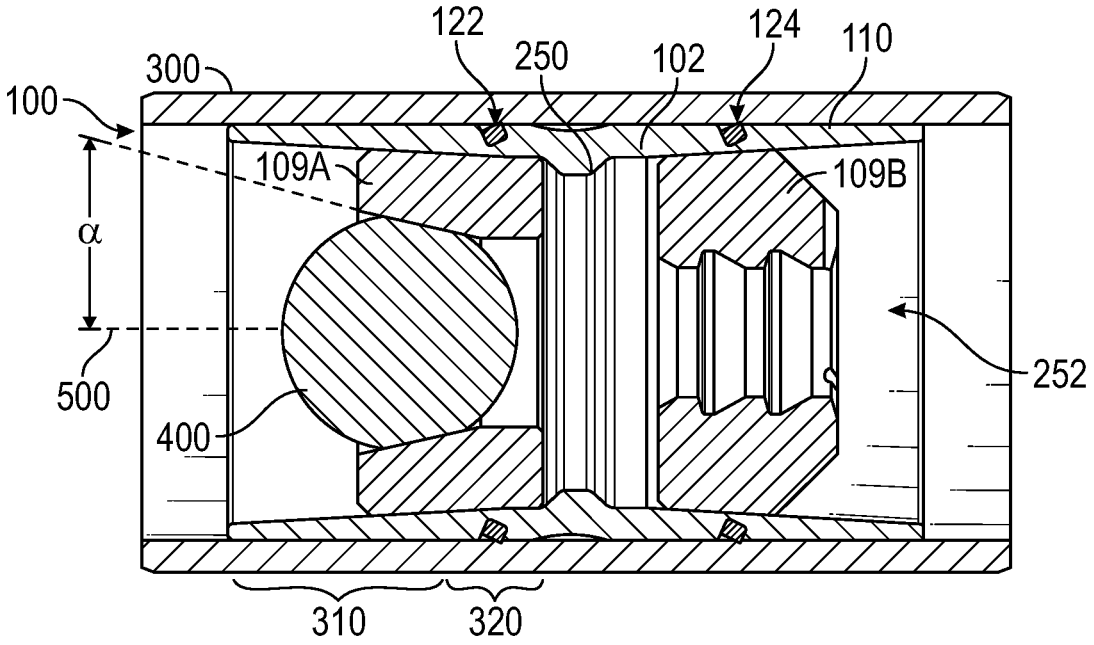
FIG. 5 illustrates a side, cross-sectional view of the downhole tool in a second set configuration, according to an embodiment.

FIG. 5 illustrates a side, cross-sectional view of the downhole tool 100 in a second set configuration and deployed into the surrounding tubular 300, according to an embodiment. Progressing from FIG. 4, the catching of the obstructing member 400 in the valve seat 265 may cause the upper cone 109A to move toward the lower cone 109B, e.g., into contact with, the shoulder 250. The lower cone 109B may be held stationary. The movement of the upper cone 109A may result in the second portion 320, in which the second row 122 of button inserts 110 is positioned, expanding radially outwards and pressing the button inserts 110 and at least some of the bands 202, 203, and/or 204 (see FIG. 2) into, or further into, engagement with the surrounding tubular 300.

In an embodiment, the valve seat 265 may define an angle $\alpha$, with respect to a central longitudinal axis 402. The angle $\alpha$ may be selected such that increased pressure uphole of the downhole tool 100 is converted to force both axially and radially in the upper cone 109A. This may cause the upper cone 109A to slide in the expandable sleeve 102, and may also provide an additional amount of radial-outward expansion of the expandable sleeve 102 via expansion of the cone 109A. Once the upper cone 109A engages the shoulder 250, the upper cone 109A is prevented from sliding farther downhole, and thus the tool 100 is effectively plugged. In some cases, the upper cone 109A may stop prior to engaging the shoulder 250, and may still plug the tool 100 in cooperation with the obstructing member 400.

Figure 6:
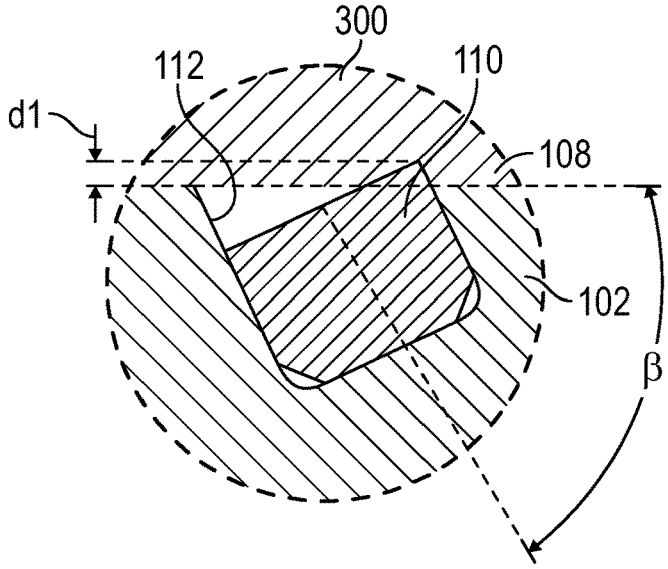
FIG. 6 illustrates an enlarged view of a button partially embedded in an expandable sleeve of the downhole tool, according to an embodiment.

FIG. 6 illustrates an enlarged view of one of the button inserts 110 in a corresponding one of the holes 112 in the expandable sleeve 102, according to an embodiment. As shown, the button insert 110 extends outwards past the outer surface 108 of the expandable sleeve 102 by the first distance d1, and terminates in an outer edge 600, which may be configured to bite into the surrounding tubular 300. Furthermore, the button insert 110 and the hole 112 are oriented at an angle $\beta$, such that this outer edge 600 is formed, e.g., as one angular interval around the top of a generally cylindrical shape of the button insert 110.

The angle $\beta$ may be selected to enhance the biting contact of the button insert 110 into the surrounding tubular 300 when the button insert 110 moves radially outward as the expandable sleeve 102 is expanded radially outwards. This contrasts with conventional (e.g., composite) slips with button inserts, which break apart and are wedged outwards by sliding axially towards one another, rather than straight radially outward. As such, the angle $\beta$ may be different than in those slips, since the angle $\beta$ may be constant across the tool 100, both upper and lower sections 126, 128 (see, e.g., FIG. 2A). Furthermore, referring again additionally to FIGS. 3A and 3B, it can be seen that the button inserts 110 may all be oriented at the same angle, due to the radial outward expansion. This too contrasts with conventional pivoting slips arrangements, in which the upper and lower slips are driven up reverse-tapered cones, leading to button inserts being oriented in correspondingly opposite directions.

Figure 8:
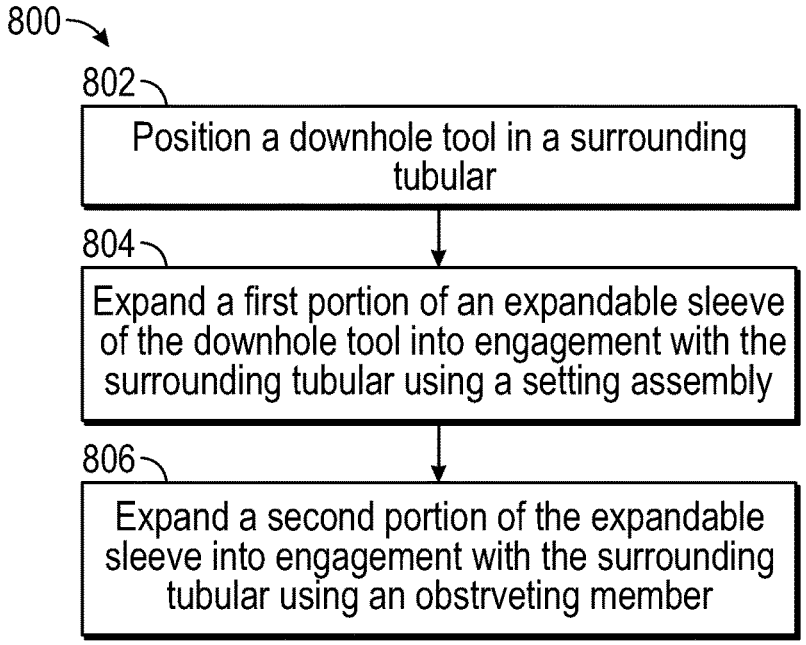
FIG. 8 illustrates a flowchart of a method for deploying a downhole tool in a wellbore, according to an embodiment.

FIG. 8 illustrates a flowchart of a method 800 for deploying a downhole tool, according to an embodiment. An embodiment of the method 800 may proceed by operation and deployment of the downhole tool 100 shown in and described above with reference to FIGS. 1-7 and will thus be described with reference thereto; however, it will be appreciated that some embodiments of the method 800 may employ other structures. The method 800 may include positioning the downhole tool 100 in a run-in configuration in a surrounding tubular 300, as at 802. The method 800 includes expanding a first portion 310 of the expandable sleeve 102, such that the downhole tool 100 is in a first set configuration, as at 804. The method 800 may then include expanding a second portion 320 of the expandable sleeve 102, as at 806, such that the downhole tool is in a second set configuration after expanding the second portion 320 of the expandable sleeve 102.

In an embodiment, the downhole tool 100 includes an upper cone 109A and a lower cone 109B positioned at least partially within the expandable sleeve 102. In such an embodiment, expanding the first portion 310 of the expandable sleeve 102 includes moving the upper cone 109A toward the lower cone 109B (possibly while moving the lower cone 109B toward the upper cone 109A) and within the expandable sleeve 102, such that at least some of the grit material and at least the first row 120 of the button inserts 110 engage the surrounding tubular 300.

In some embodiments, the upper cone 109A includes the valve seat 265. As such, expanding the second portion 320 of the expandable sleeve 102 into the second set configuration at 806 may include catching the obstructing member 400 in the valve seat 265 and applying pressure to the obstructing member 400, such that the obstructing member 400 applies a force on the upper cone 109A, causing the upper cone 109A to move closer to the lower cone 109B. Further, expanding at 806 may cause the second row 122 of the button inserts 110 to be pressed into the surrounding tubular 300. The second row 122 may be axially offset from the first row 120 and may not be pressed into the surrounding tubular 300 (or pressed to a lesser degree in distance and/or force) prior to expanding the second portion 320 of the expandable sleeve 102.

As used herein, the terms "inner" and "outer"; "up" and "down"; "upper" and "lower"; "upward" and "downward"; "above" and "below"; "inward" and "outward"; "uphole"

and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A downhole tool, comprising:

an expandable sleeve having an outer surface, wherein the expandable sleeve is configured to expand radially outwards without fracturing apart;

a plurality of button inserts positioned at least partially in the expandable sleeve and extending outward past the outer surface by a first distance, wherein the plurality of button inserts are configured to engage a surrounding tubular when the expandable sleeve is expanded;

a first band of grit material on the outer surface, adjacent to at least one row of the plurality of button inserts, wherein the first band of grit material extends outward from the outer surface by at least the first distance, wherein the first band of grit material is configured to prevent the plurality of button inserts from contacting the surrounding tubular in a run-in configuration of the downhole tool, and wherein the plurality of button inserts are configured to contact the surrounding tubular in a first set configuration of the downhole tool due to expansion of the expandable sleeve; and a second band of grit material on the outer surface, wherein the plurality of button inserts are positioned axially between the first and second bands of grit material.

2. The downhole tool of claim 1, wherein the second band extends outward from the outer surface by a second distance that is greater than the first distance.

3. The downhole tool of claim 1, further comprising a first cone positioned in the expandable sleeve, wherein the first cone is configured to slide axially with respect to the expandable sleeve to expand an upper portion of the expandable sleeve.

4. The downhole tool of claim 3, wherein the first cone comprises a bore extending therethrough and a valve seat, the valve seat being configured to receive an obstructing member that is configured to obstruct the bore and substantially prevent fluid flow in at least one direction through the expandable sleeve.

5. The downhole tool of claim 4, further comprising a second cone positioned in the expandable sleeve, wherein the second cone is configured to slide axially with respect to the expandable sleeve, and toward the first cone to expand a lower portion of the expandable sleeve.

6. The downhole tool of claim 5, wherein the second cone comprises a bore and a plurality of grooves extending outward from the bore, the grooves being configured to engage complementary ridges of a setting tool.

7. The downhole tool of claim 5, wherein:

in the run-in configuration of the downhole tool, the first and second cones are positioned at or near to respective axial ends of the expandable sleeve;

in the first set configuration of the downhole tool, the first and second cones are closer together than in the run-in configuration, wherein the first and second cones are each configured to be moved by a first axial distance toward one another within the expandable sleeve to actuate the downhole tool from the run-in configuration to the first set configuration; and in a second set configuration of the downhole tool, the first and second cones are closer together than in the first set configuration, wherein the first cone is configured to be moved toward the second cone, and the second cone is configured to be held stationary, to actuate the downhole tool from the first set configuration to the second set configuration.

8. The downhole tool of claim 7, wherein the plurality of button inserts comprises a first row of button inserts, a second row of button inserts, and a third row of button inserts, the first, second, and third rows of button inserts being axially offset from one another such that the second row is axially between the first and third rows.

9. The downhole tool of claim 8, wherein the first row of button inserts is positioned uphole of the second row of button inserts, and the second row of button inserts is positioned uphole of the third row of button inserts, and wherein in the first set configuration, the first row of button inserts and the third row of button inserts are configured to be pressed outward into engagement with the surrounding tubular to a greater extent than the second row of button inserts.

10. The downhole tool of claim 9, wherein, in the second set configuration, the first, second, and third rows of button inserts are configured to be pressed outward into engagement with the surrounding tubular.

11. The downhole tool of claim 8, wherein the first band of grit material is positioned between an uphole axial end of the expandable sleeve and the first row of button inserts, wherein the second band of grit material is positioned between the second row of button inserts and the third row of button inserts, and wherein the downhole tool further comprises a third band of grit material positioned between the third row of button inserts and a downhole axial end of the expandable sleeve.

12. The downhole tool of claim 5, wherein the expandable sleeve comprises an upper section that is configured to be pressed outward by the first cone, and a lower section that is configured to be pressed outward by the second cone, wherein the plurality of button inserts are positioned in the upper section and the lower section, and wherein the plurality of button inserts in the upper section are oriented at the same angle as the plurality of button inserts in the lower section.

13. The downhole tool of claim 1, wherein the plurality of button inserts are oriented at an angle relative to straight radial, such that an edge of the plurality of button inserts is configured to engage the surrounding tubular when pressed radially outwards.

14. The downhole tool of claim 1, further comprising a ring-shaped area that is free from grit material and positioned on the outer surface axially between the first and second bands.

15. The downhole tool of claim 14, wherein at least some of the plurality of button inserts are positioned in the ring-shaped area that is free from grit material.

16. The downhole tool of claim 1, further comprising:

a third band of grit material on the outer surface, wherein the second band of grit material is positioned axially between the first and third bands of grit material;

a first ring-shaped area that is free from grit material and positioned on the outer surface axially between the first and second bands; and a second ring-shaped area that is free from grit material and positioned on the outer surface axially between the second and third bands.

17. The downhole tool of claim 16, wherein at least some of the plurality of button inserts are positioned in the first ring-shaped area, the second ring-shaped area, or both.

18. The downhole tool of claim 16, wherein the plurality of button inserts comprises:

a first button insert in the first ring-shaped area; and a second button insert in the second ring-shaped area.

19. The downhole tool of claim 1, wherein the first band of grit material extends outward from the outer surface by a second distance that is greater than the first distance, and wherein the second band of grit material extends outward from the outer surface by the first distance.

20. The downhole tool of claim 1, further comprising a third band of grit material on the outer surface, wherein the third band of grit material is positioned axially between the first band of grit material and the plurality of button inserts.

21. The downhole tool of claim 20, wherein the first band of grit material extends outward from the outer surface by a second distance that is greater than the first distance, and wherein the second band of grit material, the third band of grit material, or both extend outward from the outer surface by at least the first distance.

22. A method for deploying a downhole tool into a wellbore, the method comprising:

positioning the downhole tool in a run-in configuration in a surrounding tubular, wherein the downhole tool comprises:

an expandable sleeve having an outer surface, wherein the expandable sleeve is configured to expand radially outwards;

a plurality of button inserts positioned at least partially in the expandable sleeve and extending outward past the outer surface by a first distance, wherein the plurality of button inserts are configured to engage the surrounding tubular when the expandable sleeve is expanded;

a first band of grit material on the outer surface, adjacent to at least one row of the plurality of button inserts, wherein the first band grit material extends outward from the outer surface by at least the first distance; and a second band of grit material on the outer surface, wherein the plurality of button inserts are positioned axially between the first and second bands of grit material, and wherein the first and second bands of grit material are configured to prevent the plurality of button inserts from contacting the surrounding tubular in the run-in configuration;

expanding a first portion of the expandable sleeve, such that the downhole tool is in a first set configuration, wherein the plurality of button inserts are configured to contact the surrounding tubular in the first set configuration; and expanding a second portion of the expandable sleeve, such that the downhole tool is in a second set configuration after expanding the second portion of the expandable sleeve.

23. The method of claim 22, wherein the downhole tool further comprises an upper cone and a lower cone positioned at least partially within the expandable sleeve, and wherein expanding the first portion of the expandable sleeve comprises moving the upper cone toward the lower cone within the expandable sleeve, such that at least some of the first band of grit material and at least a first row of the plurality of button inserts engage the surrounding tubular.

24. The method of claim 23, wherein the upper cone comprises a valve seat, and wherein expanding the second portion of the expandable sleeve into the second set configuration comprises catching an obstructing member in the valve seat and applying pressure to the obstructing member, such that the obstructing member applies a force on the upper cone, causing the upper cone to move closer to the lower cone without moving the lower cone.

25. The method of claim 24, wherein the valve seat is shaped such that the force applied on the upper cone by the obstructing member expands the upper cone, and the expandable sleeve, radially outward.

26. The method of claim 24, wherein expanding the second portion of the expandable sleeve causes a second row of the plurality of button inserts to be pressed into the surrounding tubular.

27. The method of claim 26, wherein the second row of the plurality of button inserts is axially offset form the first row, and wherein the second row of the plurality of button inserts is not pressed into the surrounding tubular prior to expanding the second portion of the expandable sleeve.

28. A downhole tool, comprising:

an expandable sleeve having an outer surface and a bore extending axially therethrough, wherein the expandable sleeve is configured to expand radially outwards without breaking apart;

a plurality of button inserts positioned at least partially in the expandable sleeve and extending outward past the outer surface by a first distance, wherein the plurality of button inserts are configured to engage a surrounding tubular when the expandable sleeve is expanded, wherein the plurality of button inserts comprises:

a first row of button inserts positioned on a first portion of the expandable sleeve; and a second row of button inserts positioned on a second portion of the expandable sleeve, the first and second rows being axially offset;

a first band of grit material on the outer surface, wherein the first band of grit material extends outward from the outer surface by a second distance that is at least as great as the first distance;

a second band of grit material on the outer surface, wherein the second band of grit material extends outward from the outer surface by a third distance that is greater than the second distance, and wherein the first and second bands of grit material are configured to shield the plurality of button inserts during run-in of the downhole tool;

a ring-shaped area that is free from grit material and positioned on the outer surface axially between the first and second bands;

a first cone positioned at least partially in the bore of the expandable sleeve; and a second cone positioned at least partially in the bore of the expandable sleeve, wherein:

in a run-in configuration of the downhole tool, the first cone is positioned proximal to an uphole end of the expandable sleeve, and the second cone is positioned proximal to a downhole end of the expandable sleeve;

in a first set configuration of the downhole tool, the first cone and the second cone are configured to be moved closer together in comparison to the run-in configuration, such that at least the first portion of the expandable sleeve is farther outward than the run-in configuration; and in a second set configuration of the downhole tool, the first cone is configured to be moved closer to the second cone, and the second cone is configured not to be moved, such that the second portion of the expandable sleeve is pressed outward by the first cone moving from the first set configuration to the second set configuration.

29. The downhole tool of claim 28, wherein the first cone comprises an uphole-facing valve seat configured to engage an obstructing member, wherein, when the obstructing member engages the valve seat and a pressure is applied to the obstructing member, the first cone is configured to be moved within the expandable sleeve toward the second cone, thereby actuating the downhole tool from the first set configuration to the second set configuration.

30. The downhole tool of claim 28, wherein the first band of grit material is configured to prevent the plurality of button inserts from contacting the surrounding tubular in the run-in configuration of the downhole tool, and wherein the plurality of button inserts are configured to contact the surrounding tubular in the first set configuration of the downhole tool due to expansion of the expandable sleeve.

* * * * *